United States Patent [19]

Eriksson

[11] Patent Number: 4,481,031

[45] Date of Patent: Nov. 6, 1984

[54] MANUFACTURE OF ALUMINIUM-SILICON ALLOYS

[75] Inventor: Sune Eriksson, Hofors, Sweden

[73] Assignee: SKF Steel Engineering AB, Hofors, Sweden

[21] Appl. No.: 526,439

[22] Filed: Aug. 25, 1983

[30] Foreign Application Priority Data

Oct. 22, 1982 [SE] Sweden ..... 8206002

[51] Int. Cl.[3] ..... C22B 4/00

[52] U.S. Cl. ..... 75/10 R; 75/68 A; 75/130 R

[58] Field of Search ..... 75/10 R, 68 A, 130 R

[56] References Cited

U.S. PATENT DOCUMENTS 3,340,020 9/1967 Neuenschwander ..... 75/10 R 4,072,504 2/1978 Perdahl et al. ..... 75/40

FOREIGN PATENT DOCUMENTS 1565065 8/1976 United Kingdom ..... 75/68 R

*Primary Examiner*—Peter D. Rosenberg

*Attorney, Agent, or Firm*—Brumbaugh, Graves, Donohue & Raymond

[57] ABSTRACT

In a method of manufacturing aluminium-silicon alloy from natural mineral containing alumina and silica and carbon powder, the natural mineral in powder form is injected together with a reducing agent in the form of a carbon carrier, with the aid of a carrier gas into a plasma gas produced in a plasma generator. The mineral thus heated is then introduced, together with the reducing agent and the energy-rich plasma gas, into a reaction chamber surrounded substantially on all sides by solid reducing agent in lump form. Examples of the natural mineral include andalusite, cyanite, silimite, nepheline, quartz, clay containing alumina, such as bauxite, and mixtures of two or more of these minerals.

8 Claims, No Drawings

MANUFACTURE OF ALUMINIUM-SILICON ALLOYS

DESCRIPTION

The present invention relates to a method of manufacturing aluminium-silicon alloy from natural mineral and carbon powder.

A small percentage of silicon is often added to aluminium to give the aluminium greater hardness, thus increasing its usefulness as a construction material. Silicon and aluminium are normally produced separately and then mixed when the aluminium is melted for subsequent casting to various components.

An aluminium-silicon alloy such as silumin is often produced, which contains 12% silicon and the remainder aluminium. This is used in the alloying of aluminium with silicon.

Primary aluminium is generally produced from bauxite using melting electrolysis which is an extremely costly process. Silicon is generally produced in electric arc furnaces from pure quartz and extremely pure coal and coke. Each of these processes requires considerable amounts of energy and place high demands on the starting materials. It is therefore of great interest to be able to recover an aluminium-silicon alloy directly from the widely available aluminium-silicon minerals, such as cyanite and andalusite. The energy consumption in such a process will be considerably lower.

Experiments in this direction have also been performed in the USSR, for instance, where attempts have been made to recover aluminium-silicon alloys from various aluminium-silicon minerals carbo-thermically in an electric arc furnace. In this case the mineral and carbon powder are mixed and formed into briquettes. After heat-treatment, the briquettes are charged into an electric arc furnace.

The drawback with this latter procedure is that the requirements of the briquettes are extremely high; the quantity of carbon must be correct and they must be strong enough not to disintegrate during charging and while in the furnace. It is of the utmost importance that there is correct porosity and conductivity in the furnace. Furthermore, the investment for the preparation of the charge is extremely high requiring equipment for milling, mixing, forming into briquettes, heat-treatment, etc. Also, the costs of the electrodes have become high.

The present invention provides a method of manufacturing an aluminium-silicon alloy from natural mineral containing alumina and silica and carbon powder, which comprises injecting (a) the natural mineral in powder form in a carrier gas and (b) a reducing agent in the form of a carbon carrier, into a plasma gas produced in a plasma generator, and introducing the mineral thus heated, together with the reducing agent and the energy-rich plasma gas, into a reaction chamber surrounded substantially on all sides by solid reducing agent in lump form.

This process enables manufacture of aluminium-silicon alloy in a single step and also enables the use of powdered raw materials.

According to a preferred embodiment of the invention the natural mineral is cyanite, andalusite, silimite, nepheline, quartz, clay containing alumina, such as bauxite, or a mixture of two or more of these minerals. Any volatile constituents contained in the minerals are vaporized and leave with the exhaust gas to be condensed out or recovered in some other suitable manner.

Examples of volatile components besides $Al_2O_3$ and $SiO_2$ which may be included in the mineral are $Na_2O$ and $K_2O$. An example of a mineral containing varying quantities of volatile compounds is nepheline.

The mineral or minerals are brought to melting and reduction by reaction with the injected carbon carrier, thus forming a liquid aluminium-silicon alloy.

The selection of silicon and aluminium raw products is facilitated and made less expensive owing to the use of powdered raw products in accordance with the invention. The process of the invention is also insensitive to the electrical properties of the raw material, which facilitates the choice of reducing agent.

The injected reducing agent may, for instance, be a hydrocarbon, such as natural gas, carbon powder, charcoal powder, anthracite, petroleum coke, possibly purified, or coke breeze.

The temperature necessary for the process can easily be controlled by means of the quantity of electric energy supplied per unit of plasma gas, in order to achieve optimal conditions for minimum electricity consumption.

According to a suitable embodiment of the invention, the solid reducing agent in lump form is supplied continuously to the reaction zone as it is consumed.

Suitable solid reducing agents in lump form are coke, charcoal, petroleum coke and/or carbon black and the plasma gas used in the process may suitably consist of process gas recirculated from the reaction zone.

The solid reducing agent in lump form may be a powder converted to lump form by means of a binder composed of C and H and possibly also O, such as sucrose.

According to another embodiment of the invention, the plasma generator is an inductive plasma generator and impurities from the electrodes are therefore reduced to an absolute minimum.

The method proposed according to the invention can advantageously be used for the manufacture of aluminium-silicon alloys of high purity. In this case extremely pure $Al_2O_3$, $SiO_2$ and reducing agent with extremely slight quantities of impurities can be used as raw products.

The invention will now be further described with reference to the Examples below. The reactions are preferably carried out in a reactor similar to a shaft furnace, which is continuously charged at the top with a solid reducing agent through a blast furnace top having separate, sealed feed channels, or an annular feed channel around the periphery of the shaft.

The powdered mineral is suitably blown into the bottom or lower part of the reactor through tuyeres with the aid of an inert or reducing gas as carrier gas. At the same time, hydrocarbon can be blown in, as well as possibly oxygen gas, preferably through the same tuyeres.

At the bottom of the shaft filled with reducing agent in lump form is a reaction chamber, surrounded on all sides by said reducing agent in lump form. Melting and reduction of $Al_2O_3$ and $SiO_2$ take place instantaneously in this reduction zone.

The reactor gas leaving, which consists of a mixture of carbon monoxide and hydrogen in high concentration, can be recirculated and used as carrier gas for the plasma gas. The excess gas may preferably be used for energy generation.

EXAMPLE 1

An experiment in accordance with the invention was performed on half commercial scale. Cyanite having a grain size of less than 2 mm was used as raw product. The "reaction chamber" consisted of coke. Carbon powder was used as reducing agent and washed reduction gas consisting of CO and $H_2$ was used as carrier gas and plasma gas.

The electric power supplied was 1000 kW. 3 kg cyanite/minute was fed in as raw product and 1.2 kg carbon powder/minute and 0.3 kg coke/minute as reducing agent.

A total of about 500 kg aluminium-silicon alloy having an Al content of 62% was produced in the experiment. The average consumption of electricity was about 11 kWh/kg aluminium-silicon alloy produced.

EXAMPLE 2

An experiment was again performed on half commercial scale. Quartz sand and $Al_2O_3$ having a grain size of less than 2 mm was used as a raw product. The "reaction chamber" consisted of coke. Carbon powder was used as reducing agent and washed reduction gas consisting of CO and $H_2$ was used as carrier gas and plasma gas.

The electric power supplied was 1000 kW. 2 kg $Al_2O_3$ and 1 kg $SiO_2$/minute was fed in as raw product and 1.2 kg carbon powder/minute and 0.3 kg coke/minute as reducing agent.

A total of about 500 kg aluminium-silicon alloy having an Al content of 62% was produced in the experiment. The average consumption of electricity was about 11 kWh/kg aluminium-silicon alloy produced.

The experiments in Examples 1 and 2 were run on a small scale and the heat loss was therefore considerable. With gas recovery the consumption of electricity can be further decreased and the heat losses will also be considerably reduced in a larger plant.

I claim:

1. A method of manutacturing an aluminium-silicon alloy from natural mineral containing alumina and silica and carbon powder, which comprises injecting (a) the natural mineral in powder form in a carrier gas and (b) a reducing agent in the form of a carbon carrier into a plasma gas produced in a plasma generator, and introducing the mineral thus heated, together with the reducing agent and the energy-rich plasma gas, into a reaction chamber surrounded substantially on all sides by solid reducing agent in lump form.

2. A method according to claim 1, in which the natural mineral is selected from a group consisting of andalusite, cyanite, silimite, nepheline, quartz, clay containing alumina and mixtures of two or more of these minerals.

3. A method according to claim 2 in which the natural mineral contains bauxite.

4. A method according to claim 1, in which the carbon carrier is a hydrocarbon.

5. A method according to claim 4 in which the carbon carrier is natural gas, carbon powder, charcoal powder, anthracite, petroleum coke optionally purified or coke breeze.

6. A method according to claim 1, in which the reducing agent in lump form is selected from a group consisting of coke, charcoal, petroleum coke, carbon black and mixtures of two or more of these.

7. A method according to claim 1, in which process gas recirculated from the reaction chamber is reused as plasma gas in the process.

8. A method according to claim 1, in which the natural mineral and reducing agent are injected together.

* * * * *